US010662643B2

(12) United States Patent
Andrick et al.

(10) Patent No.: US 10,662,643 B2
(45) Date of Patent: May 26, 2020

(54) REMOVABLE AND REPLACEABLE ANCHORED FRAME-LIKE TUNNEL GASKET CONSTRUCTION WITH SOFT CORNERS

(71) Applicants: William C. Andrick, North Canton, OH (US); Richard J. Bowers, Akron, OH (US)

(72) Inventors: William C. Andrick, North Canton, OH (US); Richard J. Bowers, Akron, OH (US)

(73) Assignee: Vertex, Inc., Mogadore, OH (US)

( * ) Notice: Subject to any disclaimer, the term of this patent is extended or adjusted under 35 U.S.C. 154(b) by 0 days.

(21) Appl. No.: 16/248,243

(22) Filed: Jan. 15, 2019

(65) Prior Publication Data

US 2019/0226202 A1 Jul. 25, 2019

Related U.S. Application Data

(60) Provisional application No. 62/619,399, filed on Jan. 19, 2018.

(51) Int. Cl.
*E04B 1/68* (2006.01)
*E21D 11/38* (2006.01)
(Continued)

(52) U.S. Cl.
CPC ..... *E04B 1/6807* (2013.01); *E02D 29/16* (2013.01); *E04B 1/6813* (2013.01);
(Continued)

(58) Field of Classification Search
CPC ..... E04B 1/6807; E04B 1/6813; E04B 2001/6818; E21D 11/385; E21D 11/05; B28B 21/563; E02D 29/045; E02D 29/16
See application file for complete search history.

(56) References Cited

U.S. PATENT DOCUMENTS 4,195,850 A * 4/1980 Berger ..... E04B 1/6812 277/650
6,129,485 A 10/2000 Grabe et al.
(Continued)

FOREIGN PATENT DOCUMENTS

DE 39 34 198 C2 4/1991
EP 0 270 287 B1 3/1991
(Continued)

OTHER PUBLICATIONS https://www.vip-polymers.com/products-item/cast-in-anchored-tunnel-segment-gaskets/, "Cast-In Tunnel Segments Gaskets" (Nov. 9, 2017) 7 pages.
(Continued)

*Primary Examiner* — Patrick J Maestri
(74) *Attorney, Agent, or Firm* — Fay Sharpe LLP

(57) ABSTRACT

A cast-in-place gasket construction for concrete structures such as tunnel segments includes a gasket body having a bottom face configured to be positioned against a surface of an associated tunnel segment. First and second gasket portions of the construction extend in different directions and are connected to each other at a first joint. The gasket portions are made of an elastomeric material having a first durometer on the Shore A hardness scale. The joint comprises an elastomeric material having a second and lesser durometer on the Shore A hardness scale. A method for replacing a damaged frame-like gasket construction is also disclosed.

19 Claims, 8 Drawing Sheets

(51) Int. Cl.

| | |
|---|---|
| ***E02D 29/16*** | (2006.01) |
| *B28B 21/56* | (2006.01) |
| *E02D 29/045* | (2006.01) |
| *E21D 11/05* | (2006.01) |

(52) U.S. Cl.

CPC ..... *E21D 11/385* (2013.01); *B28B 21/563* (2013.01); *E02D 29/045* (2013.01); *E04B 2001/6818* (2013.01); *E21D 11/05* (2013.01)

(56) References Cited

U.S. PATENT DOCUMENTS

| | | | | |
|---|---|---|---|---|
| 6,612,585 | B2 | 9/2003 | Grabe | |
| 7,488,900 | B1 * | 2/2009 | Kline | F16J 15/027 174/355 |
| 7,922,179 | B2 | 4/2011 | Andrick et al. | |
| 9,556,734 | B2 | 1/2017 | Carr | |
| 9,631,362 | B2 | 4/2017 | Hensley et al. | |
| 9,797,818 | B2 | 10/2017 | Fischer et al. | |
| 2002/0153671 | A1 | 10/2002 | Raymond et al. | |
| 2002/0164211 | A1 | 11/2002 | Gutschmidt et al. | |
| 2003/0168819 | A1 | 9/2003 | Gutschmidt | |
| 2009/0148658 | A1 | 6/2009 | Gutschmidt et al. | |
| 2015/0259905 | A9 | 9/2015 | Hensley et al. | |

FOREIGN PATENT DOCUMENTS

| | | |
|---|---|---|
| WO | WO 99/54593 | 10/1999 |
| WO | WO 01/53657 A1 | 7/2001 |
| WO | WO 2017/134420 A1 | 8/2017 |

OTHER PUBLICATIONS www.vip-polymers.com, "Globally Approved Sealing Gaskets", 7 pages. (pp. 1-11) (2017).

http://tunnelingonline.com/tunnel-segment-gaskets-cast-vs-non-cast/, Tunnel Business Magazine, "Tunnel Segment Gaskets: Cast vs. Non-cast", 7 pages (Dec. 22, 2016).

Datwyler Tunneling Brochure, "Datwyler Tunnel Gasket Solutions", 7 pages (pp. 1-11) (May 2017).

Datwyler Sealing Technologies Brochure, "Seals for Tunnel Construction—Sealing Profiles for Modern Tunnelling Methods", 12 pages (2017).

Datwyler Anchored Gaskets Brochure, 2 pages (2017).

www.arsankaucuk.com.tr, ASG Tunnel Segment Gaskets Brochure, 8 pages, (2017).

VIP-Polymers Ltd. Flyer Entitled "Why Tunnel Segment Gasket Corner Design Is Important", 1 page, 2019.

Herrenknecht Formwork Combisegments: One Pass Segmental Lining Technology, Herrenknecht Formwork Technology GmbH, 6 page flyer, Dec. 2014.

https://youtube/b_9cSGp7tpw, "Herrenknecht Formwork Combisegments Lining Panels", 2 Screengrabs, Jan. 14, 2020.

* cited by examiner

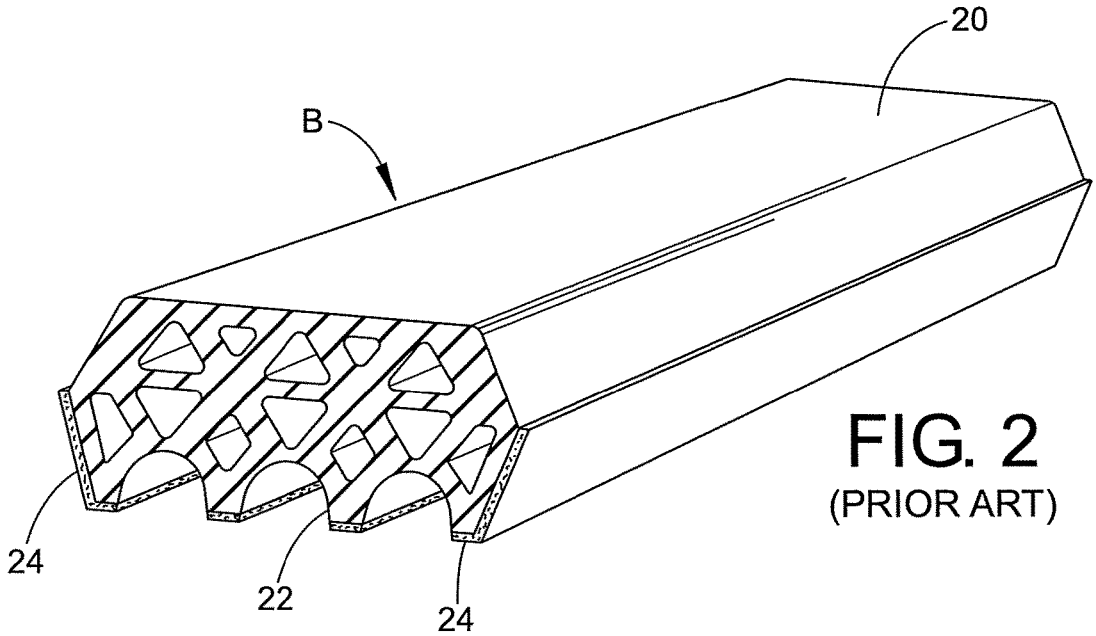
FIG. 2
(PRIOR ART)
FIG. 5
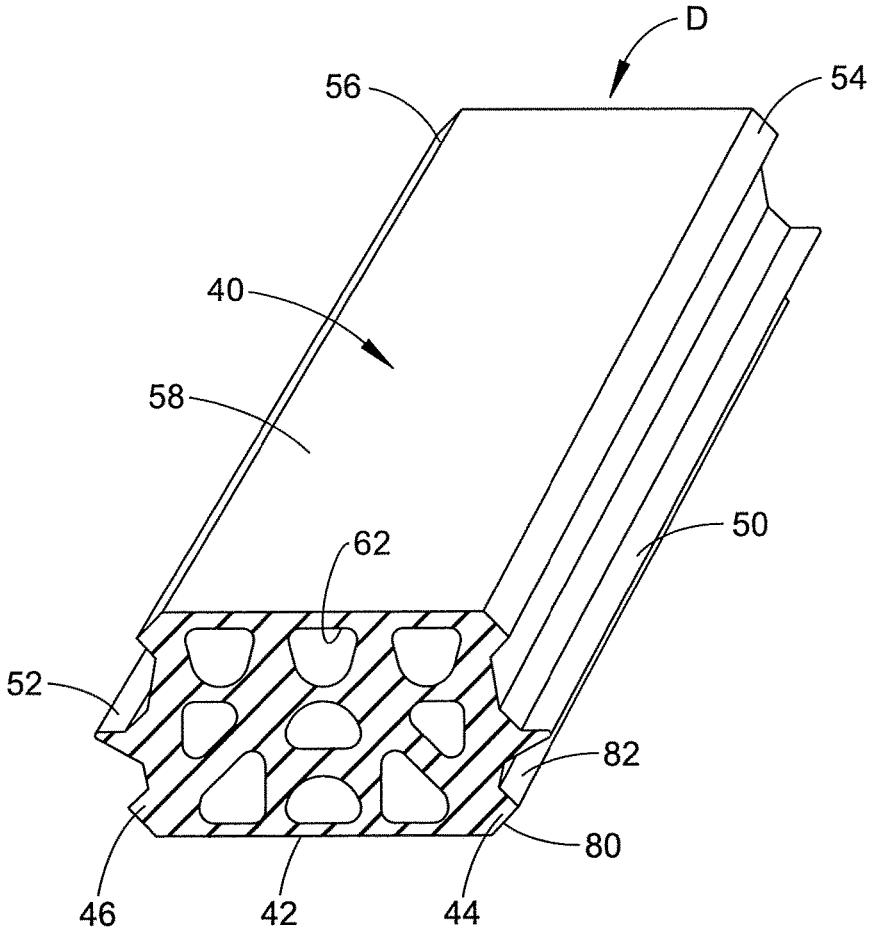

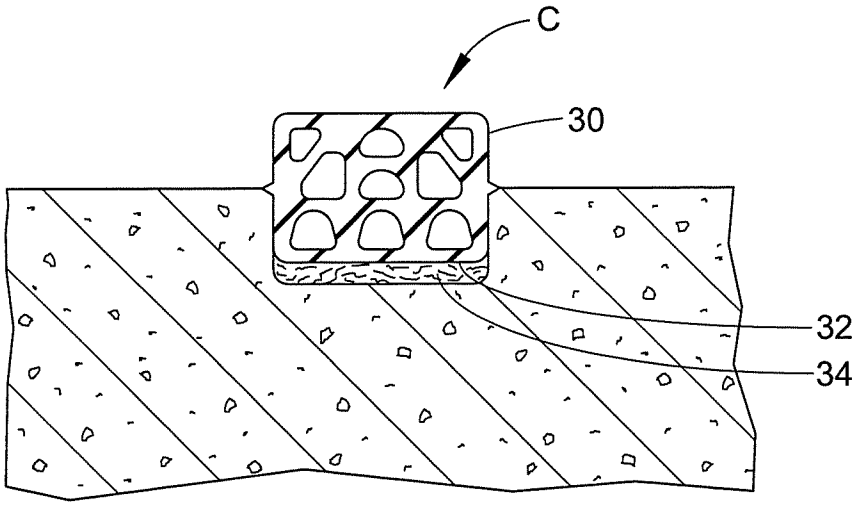
FIG. 3
(PRIOR ART)
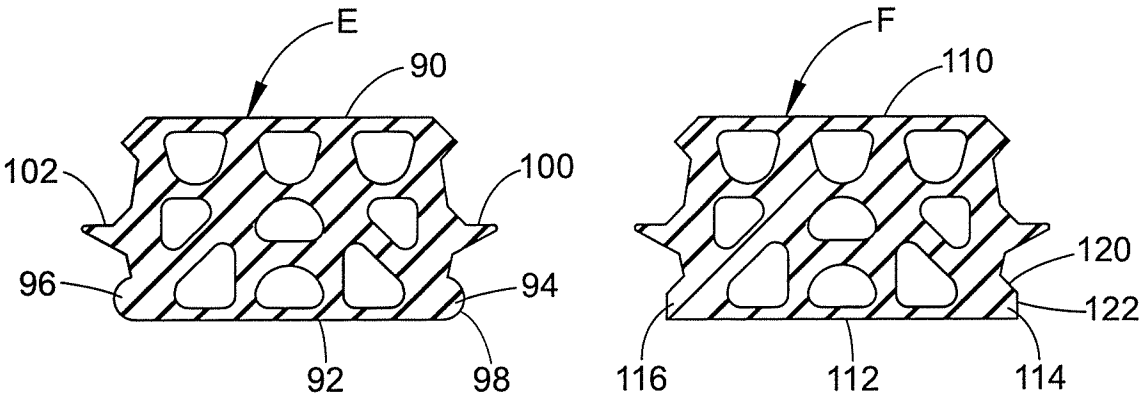
FIG. 6A
FIG. 6B
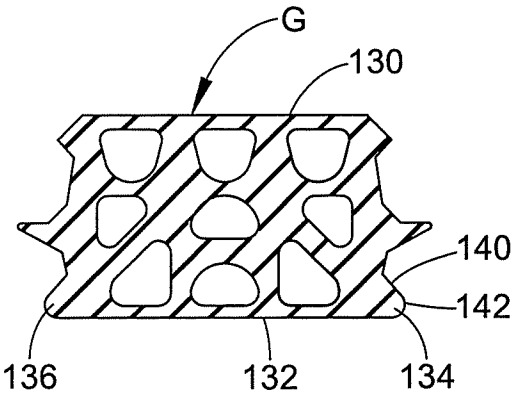
FIG. 6C

REMOVABLE AND REPLACEABLE ANCHORED FRAME-LIKE TUNNEL GASKET CONSTRUCTION WITH SOFT CORNERS

This application claims the benefit of Provisional Application Ser. No. 62/619,399 which was filed on Jan. 19, 2018. The entire content of that application is incorporated hereinto by reference.

BACKGROUND

The present disclosure pertains to gaskets or seals for sealing concrete structures, for example, the joints of tunnel segments.

In the construction of tunnels, the contact surfaces of two abutting tunnel segments, which are generally made of precast concrete, must be sealed against the inflow or outflow of liquids, most frequently water. Such tunnels may be subway tunnels, river crossing tunnels, road and railway tunnels, cable tunnels, waste water and water supply tunnels, among other types. As a general rule, the water pressure against which the seal is provided can be in the range of between 1 and 4 bar. But, water pressures are site specific and dependent on geological conditions. Reliable sealing should be insured between tunnel segments so as to prevent or retard the ingress and egress of liquids, such as water.

The current art in the field of segmented tunnel construction utilizes two basic types of gaskets. The first of these employs glued-on gasket segments. Glued gaskets are the traditional kind of installation. In this type of gasket, the concrete tunnel segment is precast with a groove being defined in the segment. The gasket is then installed in the groove with an adhesive to keep the gasket in place. If a defect is found in a glued-in gasket, either at the manufacturing facility or in the field, the gasket needs to be removed and another gasket glued into the groove in place of the removed gasket. Also, if the groove has been damaged during the removal of a defective gasket, the groove itself must be repaired first. Such repair may be problematic in the field.

Another type of segmented tunnel construction employs a gasket having anchor legs. In other words, the gasket segment is held in place as the concrete member is cast. With this type of construction, the gasket is preinstalled in a concrete form or mold and the concrete is then poured around the gasket so that the legs or anchors of the gasket are trapped in the concrete segment being formed. After curing, the segment is demolded and removed with the anchored gasket embedded into the concrete segment. Thus, the gasket is anchored in the concrete member by anchoring legs which provide a positive locking fit. For example, the anchoring legs can have a dove-tailed configuration or be provided with a cross-section that increases towards the bottom or distal face of the anchoring leg or foot. Alternatively, or additionally, the anchoring foot can be provided with a barb or undercuts and the like.

With anchored gaskets, if the gasket is damaged, then the concrete segment may need to be discarded because there is no easy way of removing such an embedded gasket from the concrete member so as to replace it with another one. If a defect is found in the anchored gasket during inspection at the manufacturing facility, current art requires significant effort to remove the gasket from the concrete segment. Such removal may render the segment unusable. This is because the segment groove must be repaired for it to be useable again. Then, a different type of gasket can perhaps be glued into the concrete segment to make the segment useable. However, if a gasket is damaged in transit or during installation of the concrete member, for example in a tunnel, there is no quick or easy way in the field to make the concrete member or segment useable again.

Another gasket design which has been recently developed, in addition to glued and feet-anchored gaskets, is a design which it is claimed anchors a gasket bottom face into a groove in a concrete segment with thousands of fibers that are disposed on a bottom face of the gasket. Such fiber anchored gaskets are said to be easily removable from the concrete segment. However, this type of gasket has its own disadvantages, a significant one being its cost. Replacement of such a gasket would necessitate using adhesive to secure a replacement gasket in the groove of the concrete segment or member, in addition to the possibly significant effort involved in cleaning the groove which may be needed before a replacement gasket can be installed.

Another difficulty with tunnel segment gaskets is accurate fitting of the gaskets at corners of the tunnel segment. This is a significant disadvantage of known cast-in tunnel segment gaskets because the gaskets are commonly provided in the form of a frame to be cast-in adjacent to the perimeter of the concrete tunnel segment. With the known designs, problems are created because excessive rubber collects at the joint where the two linear gasket segments are connected to each other. The connection is formed by injecting or "shooting" rubber into the corner joint. A solid corner joint is thus created but at the cost of significantly restricting the ability of the gasket to move. Such movement is important for two reasons. First, an inability to move hinders the performance of the gasket in the field. A solid corner joint, which is sometimes known as a "shot joint", allows the elastomeric or rubber to travel along the longitudinal channels defined in the adjoining gasket segments. Such a solid or filled corner joint hinders any compression or movement of the joint itself. As a result, existing solid corner tunnel segment gasket joints lead to excessive load that builds up at the corners of the concrete segments, such as tunnel segments. Such load will eventually lead to the concrete segments cracking at the corners. As a result, the gaskets will then not be securely held and leaks may well occur. Second, if the gaskets become defective, it becomes more difficult to remove them from the concrete segment due to the solid corner joints.

With regard to adhesively secured or fitted gaskets, the corner joint issue is ameliorated by allowing for higher arches in the gasket profile at the corners. But, as mentioned, adhesively secured gaskets are disadvantageous when it becomes necessary to replace a defective gasket, particularly in the field.

One known joining configuration which was said to be an improvement for cast-in-place frame-like tunnel segment gaskets is the provision of an elastomeric film that is relatively thin in nature, provided between the angled ends of two adjacent linear tunnel segment gaskets. However, this design is disadvantageous for a number of reasons. First, it is employed with cast-in-place tunnel segment gaskets where the feet of the gasket constitute anchoring legs, meaning that a defective gasket will need to be cut out of the groove defined in the concrete of the tunnel segment if it needs to be replaced. Clearly, this is difficult to do particularly in the field. Second, because only a thin film joint is provided between two linear gasket segments, this design necessitates the use of an additional strengthening element which is integral with the joint. Such a strengthening element, namely, a wedge located at the inner edge of the joint, is utilized to strengthen the joint and reduce failures in the joint from the linear gasket segments pulling apart at the joint. Thus, this known design still presents an angular corner which results in "point" forces acting on the corners of the concrete segment. In fact, pressure on the corners of the concrete segment is exacerbated by the presence of such wedges.

It would be desirable to eliminate any angular projection under the gasket acting on the corners of the concrete segment, loading the corners and making them more prone to failure. This would reduce the possibility that excessive load is placed on the corners of the concrete segment. It would also be desirable to produce a cast-in-place gasket with a softer, solid corner joint which does not require a separate strengthening element, and which corner joint does not place an excessive load on the corners of the concrete segment itself. Such corner joints would desirably connect four linear gasket segments into a generally rectangular or quadrilateral frame-like structure around the four sides of a concrete structure, such as a tunnel segment. This would create a frame-like gasket member. Moreover, it would be desirable to allow the entire frame-like gasket member to be removed, perhaps in an intact manner, from the concrete segment if some portion of the gasket becomes damaged and replace the entire frame-like gasket member either at the casting plant or at the job site without any extraordinary effort. In other words, it would be desirable to allow for a simplified removal and replacement of a damaged gasket construction in tunnel segments, such gasket constructions being generally frame-like or quadrilateral in structure, particularly in the field without the need to send the concrete tunnel segment back to the pre-cast plant for refitting with a replacement gasket.

Tunnel gasket designs are based on balancing the closure forces on the tunnel with the stress created to produce the necessary sealing capability required by particular project specifications. A constant balanced tension is required on the gaskets in order to achieve a reliable seal. Industry experts have voiced some concern regarding the potential effects of the Poisson coefficient on concrete when the closure forces allow the gasket material to flow to a point where there is a concentrated load on the corner of the last tunnel segment being installed to create the tunnel ring.

The Poisson coefficient or Poisson ratio is the negative ratio of transverse strains to axial strains on a material. When a compressive force acts on concrete, two types of strains will crop up. A first strain acts along the horizontal axis, and a second strain acts along the vertical axis. For static loads, such as in concrete, the coefficient should be about 0.20.

It would be desirable to provide a gasket which, through the function of its attachment to the concrete of the tunnel segment, precludes or minimizes the effects of the Poisson coefficient on the concrete tunnel segment by reducing the flow characteristic of the anchored gasket, versus present gasket designs used in the construction of tunnels.

It would also be advantageous to reduce labor costs that need to be incurred for field removal and replacement of gaskets because labor costs are a major component of construction project budgets. These project costs are typically cost-shared by local, state and national funding programs that are driven by tax and bond revenues.

It would therefore be desirable to provide a gasket which functions as an anchored gasket during the manufacture of concrete segments whereby an anchor element or elements act to attach or mount the gasket to the concrete segment, but which anchor element or elements allow the gasket to be removed and replaced in an economical manner if the gasket becomes damaged. It would also be desirable to provide a gasket construction which can be replaced with another gasket at the casting plant, in the storage yard, or on the job site without the need for extraordinary efforts or equipment, particularly as to field removal and replacement of the gasket. Also desirable would be the utilization of an identical replacement gasket which maintains the design criteria of the project without fear of violating any approved design parameters.

BRIEF SUMMARY

According to one embodiment of the present disclosure, a selectively detachable gasket construction is provided for concrete structures. The gasket construction comprises a first gasket portion extending in a first direction and a second gasket portion extending in a second direction which is angled away from the first direction. A corner joint connects the first and second gasket portions. The first and second gasket portions each comprise an elastomeric material having a first durometer on the Shore A hardness scale. The corner joint comprises an elastomeric material having a second durometer on the Shore A hardness scale, such that the corner joint is softer than either the first or the second gasket portions.

According to another embodiment of the present disclosure, a method for replacing a damaged tunnel segment gasket comprises locating a first tunnel segment gasket construction comprising four sides and four corner joints, the four sides of the first gasket construction comprising an elastomeric material of a first durometer and the four corner joints comprising an elastomeric material of a second, and lesser, durometer, in a groove of a tunnel segment. The first tunnel segment gasket construction is pulled out of the groove in the tunnel segment, wherein the corner joints and the material of the gasket sides allow the first tunnel segment gasket construction to flex sufficiently such that it can be pulled out of the groove in the tunnel segment. A second tunnel segment gasket construction is provided which comprises four sides and four corner joints, the four sides of the second gasket construction comprising an elastomeric material of the first durometer and the four corner joints comprising elastomeric material of the second, and lesser, durometer. The second gasket construction is installed in the groove of the tunnel segment.

BRIEF DESCRIPTION OF THE DRAWINGS

The disclosure may take physical form in certain gasket designs and arrangements, several embodiments of which will be described in detail in the specification and illustrated in the accompanying drawings which form a part hereof and wherein:

FIG. 2 is a perspective view of a second type of prior art gasket which can be glued in place in a groove formed in a concrete segment;

FIG. 3 is a perspective view of a third type of prior art gasket which is said to be fiber-anchored in a groove formed in a concrete segment;

FIG. 5 is a perspective view of the gasket of FIG. 4;

FIG. 6A is a cross-sectional view of a gasket according to another embodiment of the present disclosure;

FIG. 6B is a cross-sectional view of a gasket according to still another embodiment of the present disclosure;

FIG. 6C is a cross-sectional view of a gasket according to yet another embodiment of the present disclosure;

DETAILED DESCRIPTION

Figure 1:
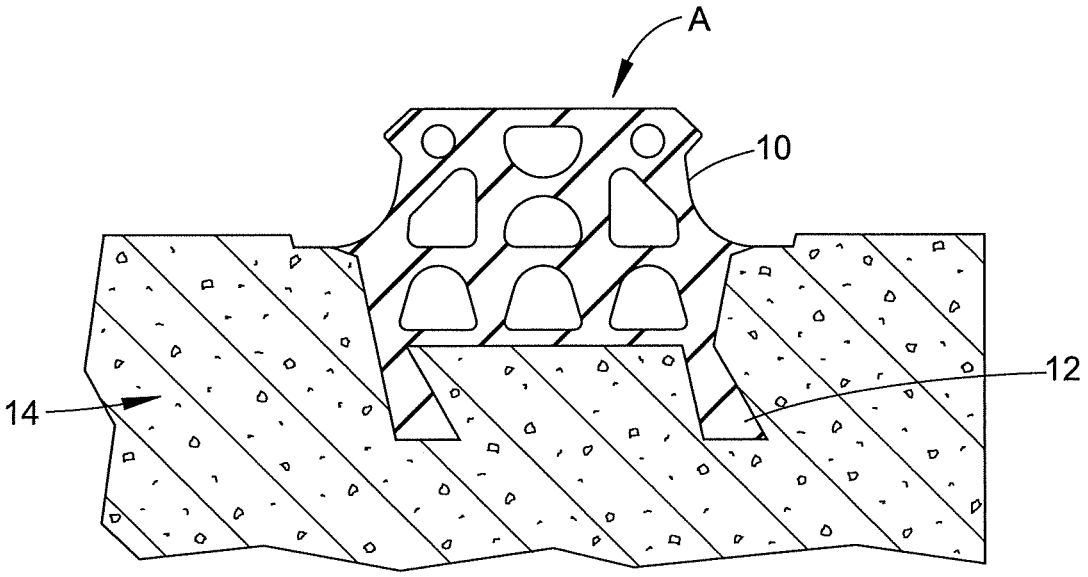
FIG. 1 (PRIOR ART)
FIG. 1 is cross-sectional view of a portion of a concrete segment provided with a first type of prior art gasket which is anchored into the concrete segment.

It should be understood that the description and drawings herein are merely illustrative and that various modifications and changes can be made to the gaskets disclosed herein without departing from the present disclosure. In the drawings, the showings illustrate several embodiments. Several gasket designs according to the prior art and according to the instant disclosure are discussed but the instant disclosure is not intended to be limited to the disclosed embodiments.

With reference to FIG. 1, a gasket A according to a first known design of the prior art includes a gasket body 10 which is provided with one or more depending anchoring feet 12. These are embedded in a concrete segment 14 as the concrete is poured around the gasket. Such prior art gaskets, also known as cast-in-place gaskets, are directly anchored in the concrete segment via the anchoring feet 12 in order to keep the gasket in position in the concrete segment. As mentioned above, removal and replacement of the gasket A is difficult because the feet are embedded in the concrete. In fact, in the field, there is no quick or easy way to replace a defective gasket and make a concrete segment with such a defective gasket usable again.

FIG. 2 illustrates a second known prior art design in which a gasket B includes a gasket body 20 which is provided with one or more legs 22 forming a bottom surface of the gasket. The legs and also opposing lower side faces of the gasket body 20 can be secured in place in a groove formed in a precast concrete segment by gluing the gasket to the concrete segment via a conventional adhesive 24. The adhesive is located between the bottom face of the gasket and the lower side faces thereof and the adjacent walls of the groove formed in the concrete segment. Field removal of a defective gasket B incurs significant labor costs. These include the removal of a defective gasket, the cleaning of the groove to remove any remaining gasket material or adhesive, the installation of a replacement gasket, and securing the replacement gasket in place with adhesive.

FIG. 3 illustrates a third known prior art design in which a gasket C is mounted in a groove formed in a concrete segment. In this design, a lower face 32 of a gasket body 30 is provided with a fiber layer 34. However, fiber-anchored gaskets may not be anchored in the groove sufficiently firmly, particularly during the process of installing tunnel segments. Also, the necessity of providing the gasket bottom with thousands of fibers add significantly to the cost of this prior art gasket.

Figure 4:
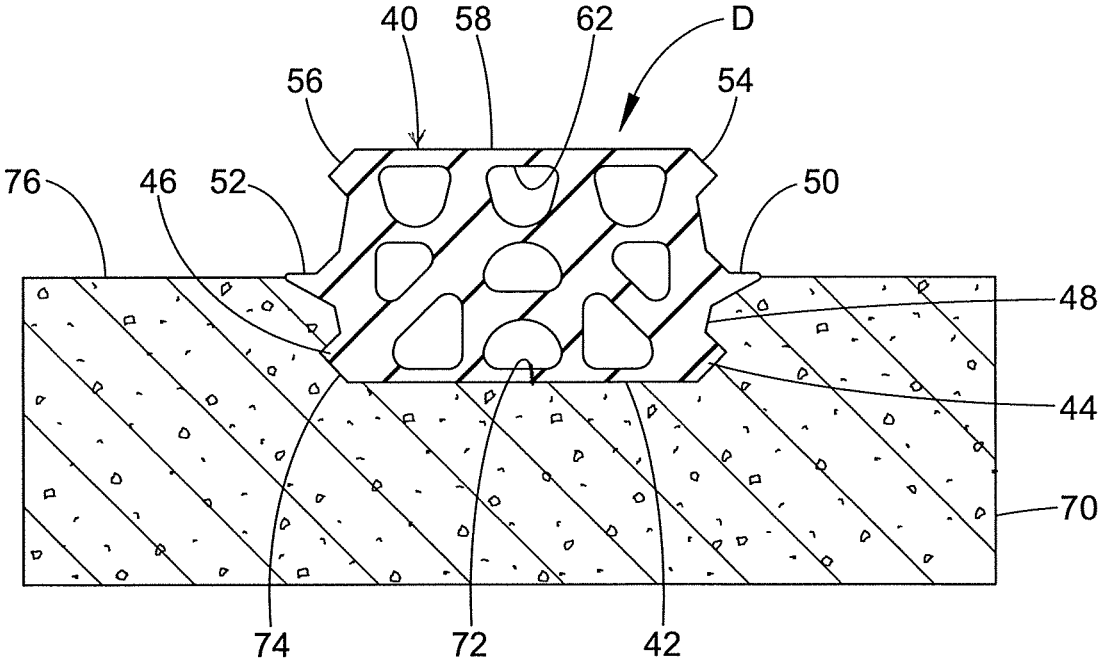
FIG. 4 is a cross-sectional view of a gasket according to one embodiment of the present disclosure, as installed in a concrete segment.

With reference now to FIG. 4, a gasket D according to a first embodiment of the present disclosure includes a gasket body 40 which includes a base wall 42. First and second anchor members 44 and 46 protrude from the gasket body. These are located on opposed side walls 48 of the gasket body and are located adjacent the gasket base wall 42. In one embodiment, the anchor members 44 and 46 can be considered as protrusions which in cross-section can have at least two planar wall sections that are oriented at an acute angle in relation to each other. Of course, other shapes are also contemplated for the anchor members, as will be discussed below. The anchor members 44 and 46 serve to retain the gasket in the groove of the concrete segment mold during casting of the precast concrete member or segment.

The gasket body 40 also includes opposed first and second lips 50 and 52 which can extend from the two opposed side walls 48. As is evident from FIG. 4, the lips serve to seal the groove in the concrete segment mold. Furthermore, the lips are considered advantageous in that they can serve to retard the seepage of liquids into the groove defined in the surface of the concrete segment. In this design, the gasket body also includes first and second protrusions 54 and 56 which are located on the opposed side walls 48 adjacent a top wall 58 of the gasket body. It should be apparent from a review of FIG. 4 that in this embodiment of the gasket, the first and second lips 50 and 52 are vertically spaced from the first and second anchor members 44 and 46. Similarly, the first and second protrusions 54 and 56 are vertically spaced from the lips 50 and 52. Thus, the lips 50 and 52 are disposed between the anchor members 44 and 46 on the one hand, and the first and second protrusions 54 and 56 on the other hand. It is also noted that the anchor members 44 and 46 are larger than are the first and second protrusions 54 and 56 in this embodiment of the gasket. Of course, other designs are also contemplated.

It should be apparent that one or more bores 62 of varying shapes in cross-section, including, triangular, semi-circular, bell-shaped or U-shaped, among others, can extend longitudinally through the gasket body 40 as is known in the art.

As mentioned, the gasket D is selectively secured to or mounted to a concrete segment 70, namely, the gasket is positioned in a groove 72 defined in the segment. The gasket D is held in place while the concrete member is cast around the gasket. Thus, the gasket defines or forms a groove in the concrete which flows around it. The first and second anchor members 44 and 46 extend into side channels 74 defined in the groove 72 of the concrete segment 70. It should be apparent from FIG. 4 that the anchor members 44 and 46 are held in the groove defined in the concrete segment. The anchor members provide a V-shape to the side channels 74 in this embodiment, in a complimentary fashion so that the anchor members simply sit in the side channels in use.

Should the original gasket in the concrete member or segment require replacement, the original or old gasket can be removed by simply pulling the gasket out of the groove and a replacement or new gasket can be snapped into place. The gasket can be pulled out of the groove due to the inherent resiliency of the material from which the gasket is manufactured. The first and second anchor members 44 and 46 are sized such that the gasket body is selectively detachable from the groove 72 defined in the concrete segment 70. The side channels 74 are located adjacent the side edges of the groove 72 such that the apexes of the V-shaped channels 74 defined in this embodiment are located above a base surface of the groove 72. Due to the resilient nature of the material from which the gasket is made, the gasket body 40 is able to flex enough so that a damaged gasket is removable and replaceable when that becomes necessary. The first and second lips 50 and 52 are positioned at a surface 76 of the concrete segment as is evident from FIG. 4.

With reference now also to FIG. 5, in the embodiment illustrated, the gasket D can extend a desired length, normally the length of the face of the concrete segment, and can include two opposed planar wall segments 80 and 82 which define each of the anchor members 44 and 46. As mentioned, the two planar or flat wall segments 80 and 82 can be disposed at an acute angle in relationship to each other. Thus, a generally V-shaped configuration in cross-section is provided for each of the anchor members 44 and 46. While the anchor members 44 and 46 are illustrated as containing two planar wall segments, it should be appreciated that anchor members having other geometric shapes, which may include three or more planar or otherwise-shaped wall segments is also contemplated.

An interference fit is provided between the groove 72 of the concrete segment 70 and the gasket body 40 such that the anchor members 44 and 46 can snap into and be pulled out of the side channels 74. One advantage of the gasket D is that it can be removed from groove 72 without the need for extraordinary effort or equipment. The reason why the gasket D can be selectively removed from its groove 72 without extraordinary effort is that the anchor members are so sized and the gasket is comprised of an elastomeric material which allows the gasket body to be selectively detachable from the groove 72. This construction allows a defective gasket to be replaced in the field if that becomes necessary.

The gasket D may be made from a suitable elastomeric material such as, for example, ethylene propylene diene monomer (EPDM) rubber. Alternatively, one or more other elastomers having a Shore A hardness in the range of 30 to 75 can also be used. As such, many elastically deformable synthetic materials are useable for the material of the several gasket embodiments disclosed herein. Also, dual hardness gasket constructions are contemplated which can include a harder anchor section (i.e. the two anchor members being of a greater durometer) and a softer sealing section, i.e., the remainder of the gasket body being of a lesser durometer, or at least selected portions thereof can be of a lesser durometer. A co-extrusion of two different durometers is thus contemplated in this embodiment. Alternatively, the body can be stiffer and the anchor sections softer under some circumstances.

With this design, the gasket D functions as an anchored gasket for concrete segment manufacturing. Yet, the gasket can be removed if it becomes damaged and replaced with another gasket either at the casting plant, in the storage yard, or on the job site. No extraordinary efforts or equipment are required for field removal and replacement of the gasket D. In this way, labor costs are greatly decreased, positively affecting project budgets. Moreover, no additional material, such as adhesive or fibers (which can be costly), is necessary to mount the gasket D to a concrete segment and secure it in place.

In one embodiment, the gasket can have a thickness of about 0.7 inches (1.8 cm) and a width of about 1.21 inches (3.07 cm) at the tips of the anchor members 44 and 46. The fins or lips 50 and 52 may protrude outwardly from the body 40 of the gasket such that the complete width of the gasket can be about 1.425 inches (3.62 cm). The width of the gasket at the first and second protrusions 54 and 56 can be about 1.152 inches (2.93 cm), if so desired. It should be appreciated that the lips 50 and 52 can be so located on the side surfaces of the gasket that the top surface of the lip is about 0.382 inches (0.97 cm) below the top surface of the gasket.

The anchor tip area of the gasket D basically needs to provide an inset recess which allows the concrete to enclose or trap the gasket base. Dimensionally, the anchor tip dimension can range from 0.060 to 0.200 inches (0.15 to 0.51 cm) per side depending upon the size of the gasket profile. Gasket profiles can range from 0.095 to 1.750 inches wide (0.24 to 4.45 cm). Since the gasket body "hinges" during its removal or replacement, the extension dimension of the anchor tips into the concrete will be altered as necessary based on the profile's overall width.

With reference now to the embodiment illustrated in FIG. 6A, a gasket E according to another embodiment of the instant disclosure includes a gasket body 90 having a base wall 92. Positioned on opposed side edges of the base wall 92 and extending from the side walls of the gasket E are first and second anchor members 94 and 96. In this embodiment, the anchor members have a generally semi-circular, curved or rounded configuration in cross-section as at 98. The anchor members 94 and 96 are designed to cooperate with suitably shaped side channels formed in a concrete segment (not illustrated). Also provided are first and second lips 100 and 102. As with the embodiment of FIG. 4, a defective or damaged gasket E can be removed from a groove in the concrete segment and replaced if that becomes necessary in the field without having to either scrap the concrete segment or send it back to the casting facility for repair or replacement of the gasket. The rounded face 98 of the first and second anchor feet 94 and 96 allows the gasket E to be readily snapped into the side channels formed in the concrete segment groove and be removed therefrom without undue effort.

With reference now to FIG. 6B, a gasket F according to still another embodiment of the present disclosure includes a gasket body 110 which is provided with a base wall 112, as well as anchor members 114 and 116 located on opposed side edges of the base wall. In this embodiment, the anchor members each include a first planar section 120 and a second planar section 122. Unlike the V-shaped configuration illustrated in the embodiment of FIGS. 4 and 5, FIG. 6B shows an embodiment in which the two planar sections of the anchor members are not disposed at an acute angle in relationship to each other. Rather, they are disposed at an obtuse angle in relationship to each other. As with the previous embodiments, the gasket F can be removed from side channels defined in a groove in a concrete segment without undue effort and a new gasket can be installed if that becomes necessary, even in the field.

With reference now to FIG. 6C, illustrated there is a gasket G according to yet another embodiment of the present disclosure. This embodiment includes a gasket body 130 having a base wall 132 and first and second anchor members 134 and 136 disposed on opposed side edges of the base wall of the gasket body. In this embodiment, the anchor members 134 and 136 each include a planar or flat upper section 140 and a rounded or curved lower section 142 disposed beneath the planar section. It should be appreciated that the side channels defined in the groove of the concrete segment are correspondingly shaped in the process of the concrete being cast around the gasket so as to readily accommodate the anchor members 134 and 136.

Figure 7:
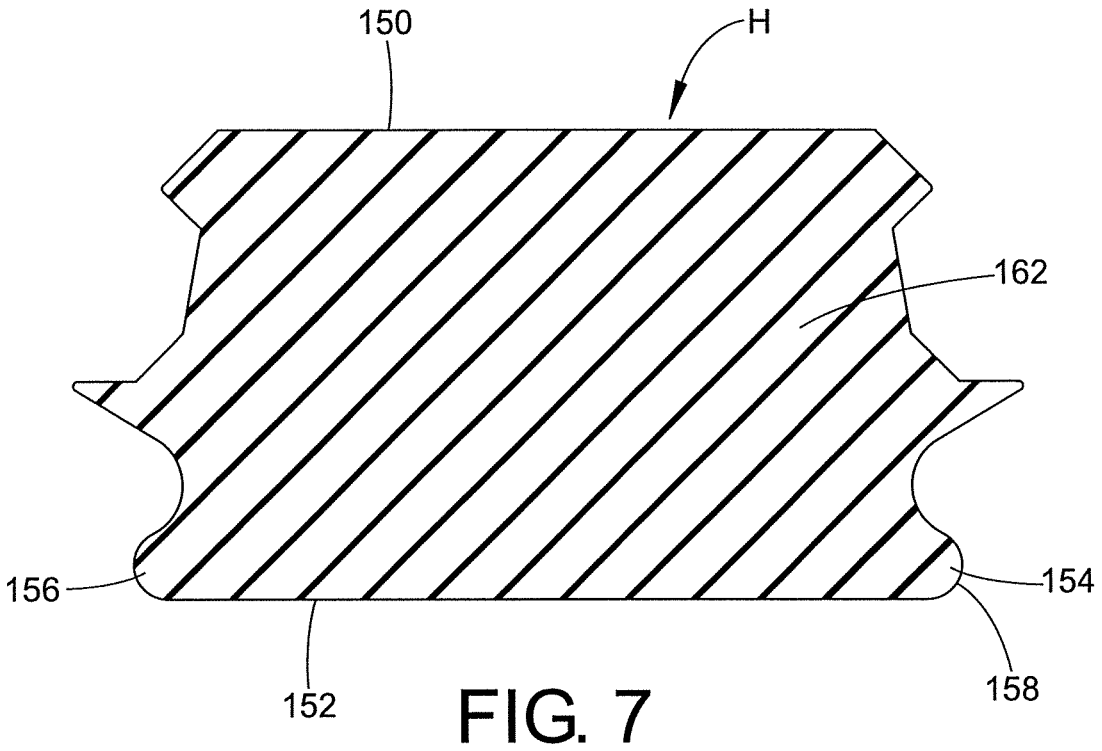
FIG. 7 is a cross-sectional view of a gasket according to a further embodiment of the present disclosure.

With reference now to FIG. 7, illustrated there is a gasket H according to a further embodiment of the present disclosure. This embodiment includes a gasket body 150 having a base wall 152 and first and second anchor members 154 and 156 which are disposed on opposed side edges of the base wall and located at the side walls of the gasket body. In this gasket embodiment, the anchor members 154 and 156 can each have a rounded face as at 158. In this embodiment, the gasket body 150 can be made of a closed cell sponge-type elastomeric material 162. Unlike the embodiments illustrated in FIGS. 4, 5 and 6A-6C, the gasket body 150 does not have any longitudinally extending bores defined in the gasket body. In the absence of bores, the closed cell sponge-like material 162 of the gasket H needs to be compressible enough so that it can be relatively easily removed from a groove defined in a concrete segment if that becomes necessary with the respective anchor members of a replacement gasket snapping into the side channels in the groove.

As previously noted, the material of the gasket body in the embodiments of FIGS. 4-6C can typically be made of EPDM (ethylene propylene diene monomer) or Neoprene (polychloroprene or pc-rubber) which is a synthetic rubber that can have a durometer of 65 to 75 on the Shore A hardness scale. Regarding the sponge-type gasket H illustrated in FIG. 7, the material can be a medium to firm density EPDM, Neoprene or a similar rubber material. It can be a 2A3/2A4 or 2C3/2C4 material on the ASTM D1056 standard for cellular materials. The density of the material would be determined based on the closure force required for the contemplated concrete tunnel segments. In this type of material, instead of a durometer measurement on the Shore A hardness scale, the force in PSI which is required to compress the material to 25% of its thickness is measured and stated in compression deflection units. One advantage of the material illustrated in FIG. 7 is that the sponge-type material of the gasket is designed to compress with less force than the generally more dense material of the gaskets illustrated in FIGS. 4-6C. The sponge-type gasket H would be most frequently used in low pressure applications (<5 bar) where installation methods rely on the weight of the concrete segment to close the joints. Such joints are generally found in vertical installations, such as in shafts and the like.

Figure 8A:
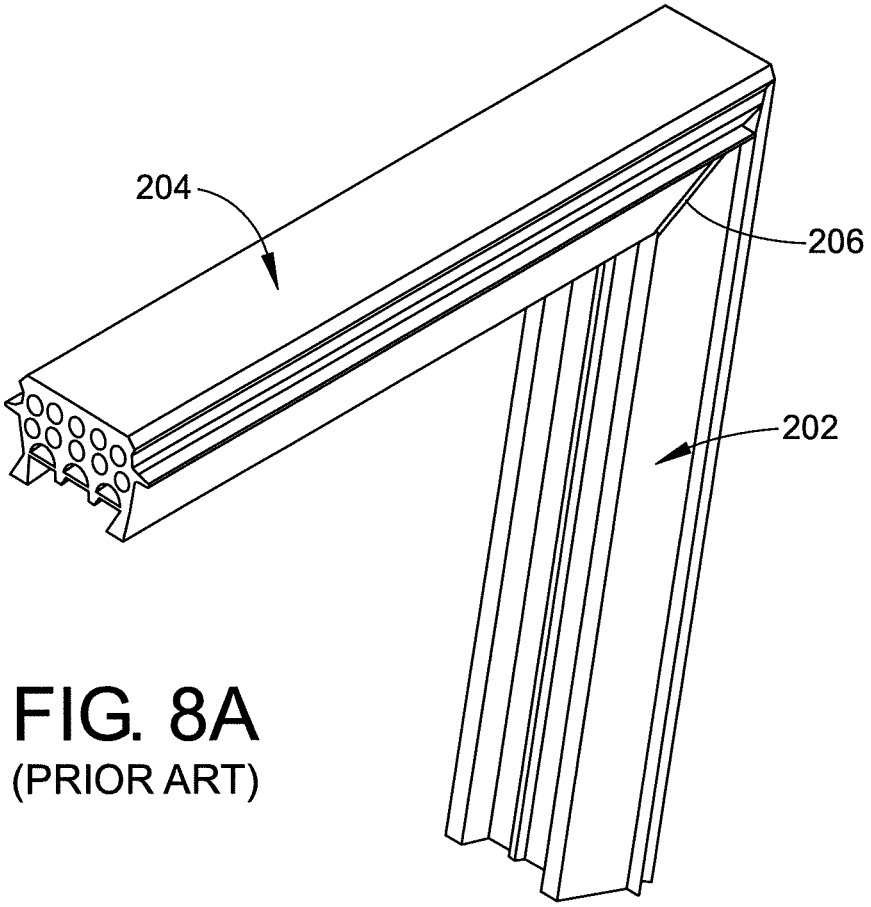
FIG. 8A (PRIOR ART)
FIG. 8A is a perspective view of a gasket corner joint according to a known design.
Figure 8B:
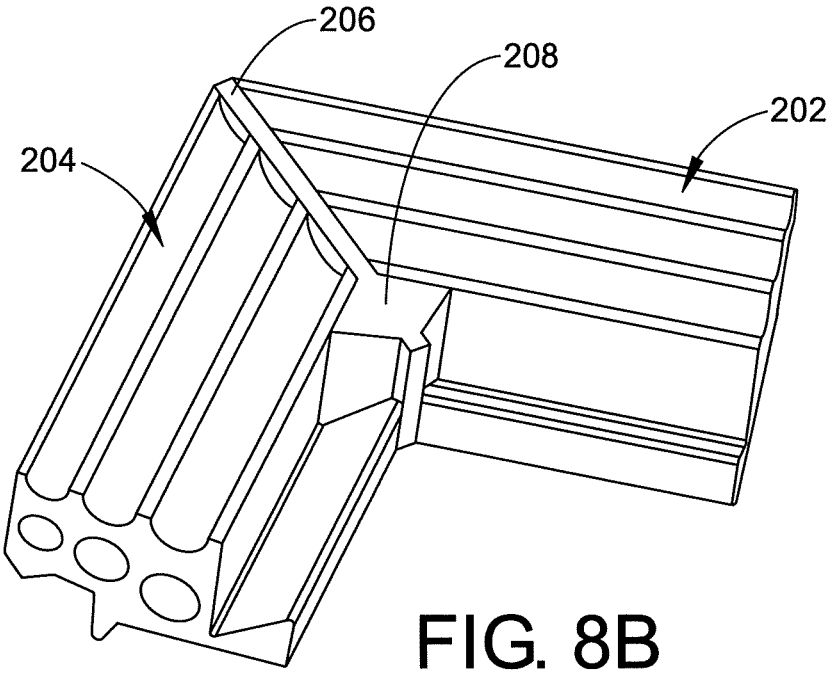
FIG. 8B (PRIOR ART)
FIG. 8B is an enlarged perspective view of a portion of the known gasket corner joint of FIG. 8A.

Illustrated in FIG. 8A is a known corner joint construction. In this construction, a first linear gasket section 202 is connected to a second linear gasket section 204, which is oriented at substantially right angles to the first section via a shot film joint 206. In this known joint design, because the film joint is so thin, a strengthening element, such as a wedge-shaped element 208 (see FIG. 8B) is also required. It is believed that this known joint is manufactured by placing a layer of rubber into a splicing fixture between two extrusions and vulcanizing the rubber film to the two extrudates. In this known design, the film has to be thin enough to cure quickly. It is believed that the film is in the neighborhood of 1.5 to 2.5 mm (0.059 to 0.098 inches) thick. That is the reason why the wedge-shaped strengthening element 208 has to be employed to strengthen the joint and reduce the potential for failures in the joint from the gasket segments 202 and 204 pulling apart, due to the thinness of the film joint 206.

It should be apparent from FIG. 8A that the known joint construction is employed with a gasket having anchor legs, such as is illustrated in FIG. 1 herein. As a result, a defective cast-in-place or anchored gasket in a concrete construction, such as a tunnel segment, needs to be cut out of the groove formed by the gasket, because the legs remain trapped in the concrete segment. A replacement gasket would then need to be glued in place. Removal of the prior art gasket may also be hindered by the known joint construction in that the corner joint with its wedge-shaped strengthening element may damage the concrete segment, either during use or during the removal process.

Figure 9:
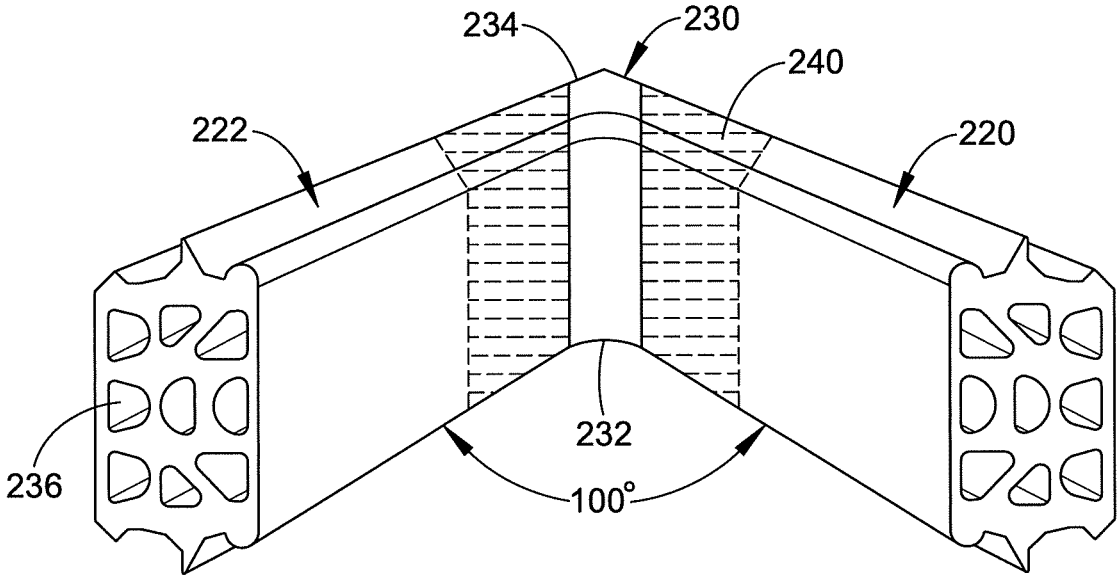
FIG. 9 is a gasket corner joint according to a first embodiment of the present disclosure.

With reference to FIG. 9, one embodiment of a joint design according to the present disclosure includes two gasket segments 220 and 222 which can be identical to any of the gasket designs illustrated in the embodiments of FIGS. 4-7 herein. In this particular embodiment, the gasket sections 220 and 222 are similar, if not identical, to the gasket design illustrated in FIG. 4. The two linear gasket segments 220 and 222 are connected at a molded corner joint 230. Unlike the prior art design "shot joint" illustrated in FIGS. 8A and 8B, the joint 230 can be 8 to 12 mm thick in order to strengthen the joint.

Importantly, the joint 230 includes a radiused inner corner portion 232. In other words, a non-angular inner corner is provided for the joint. The provision of a radiused or rounded inner corner portion for the corner joint has the benefit of reducing stresses at the corners of the concrete segment to which the gasket is secured. The inside radius can be 0.250-0.375 inches (0.635-0.953 cm), if so desired. In contrast to the radiused inner corner, it can be seen that an outer corner 234 of the joint can be angular in construction so that the two sides of the outer corner meet at a point.

Ideally, the elastomeric material of the joint penetrates into the several apertures or bores 236 defined in the gasket sections 220 and 222 to a limited extent. This extrusion material or extrudate can flow into the several bores 236 with a depth of inflow generally being about 0.8 inches (20 mm) into the several bores or apertures 236. A depth of inflow of the elastomeric material into the bores 236 of the gasket sections 220 and 222 will typically not exceed 0.813 inches (20.65 mm). An inflow area of the elastomeric material into the bores of the gasket segments is identified by the numeral 240.

Figure 10:
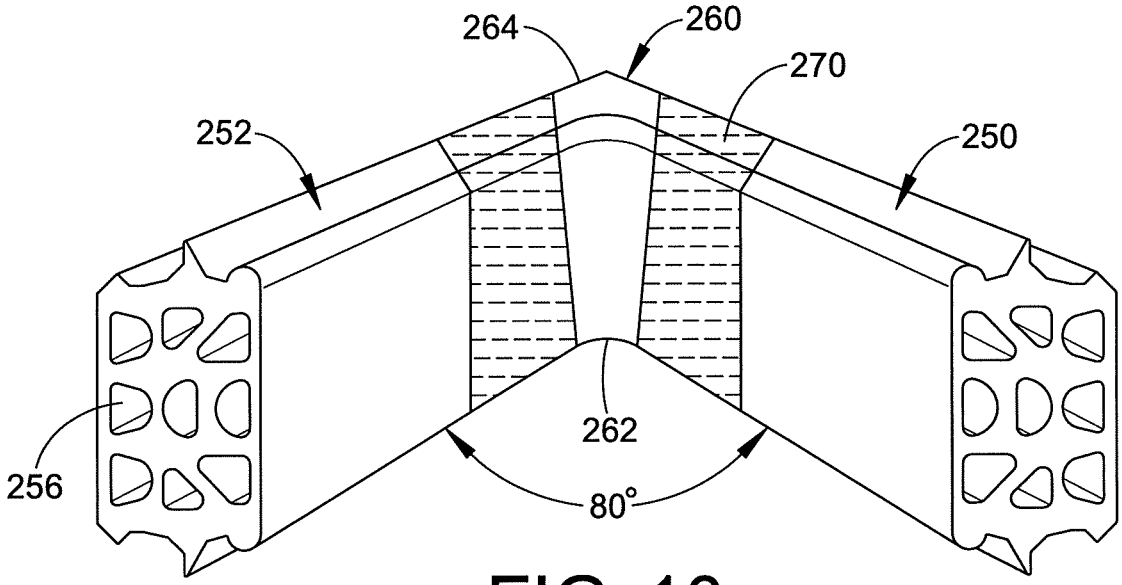
FIG. 10 is a gasket corner joint according to a second embodiment of the present disclosure.

With reference now to FIG. 10, disclosed there are two linear gasket segments 250 and 252 that are oriented at an angle in relation to each other and joined to each other. Each gasket segment includes one or more longitudinally extending bores 256. The gasket segments 250 and 252 are joined to each other at a corner joint 260. The corner joint includes a radiused inner corner portion 262 and can include an angular outer corner joint portion 264.

As with the embodiment of FIG. 9, a depth of an inflow zone 270 of the corner elastomeric material into the bores 256 in the embodiment of FIG. 10 of the connected gasket segments 250 and 252 can be on the order of 0.813 inches (20.65 mm).

In one embodiment, the inner joint corner 232, 262 can be radiused at between 0.250 to 0.375 inches (0.635 to 1.905 cm). The corner thickness will likely vary by the angle. For example, FIG. 9 illustrates an embodiment in which the corner angle, the angle between the two linear segments 220 and 222, is about 100°. In contrast, FIG. 10 illustrates an embodiment in which the corner angle is about 80°. Of course, a corner angle of 90° is also contemplated, as are any angles between 80° and 100°. The corner thickness can be a minimum of 0.250 inches (6.35 mm) and a maximum of 0.813 inches (20.65 mm). These are the typical thicknesses of the solid corner injection area according to these embodiments of the present disclosure.

The corner portions, for example, can be molded from a 60±5 durometer (on the Shore A harness scale) EPDM elastomeric or rubber material. Thus, it should be appreciated that the corner 230, 260 is made from a more resilient, i.e., softer, elastomeric material than are the gasket segments themselves. The gasket segments can be made, for example, from a 70±5 durometer (on the Shore A harness scale) EPDM elastomeric material. In one embodiment, the elastomeric material of the corner joint can be significantly less stiff than the material of the gasket segments by 5 durometers on the Shore A hardness scale.

Figure 11:
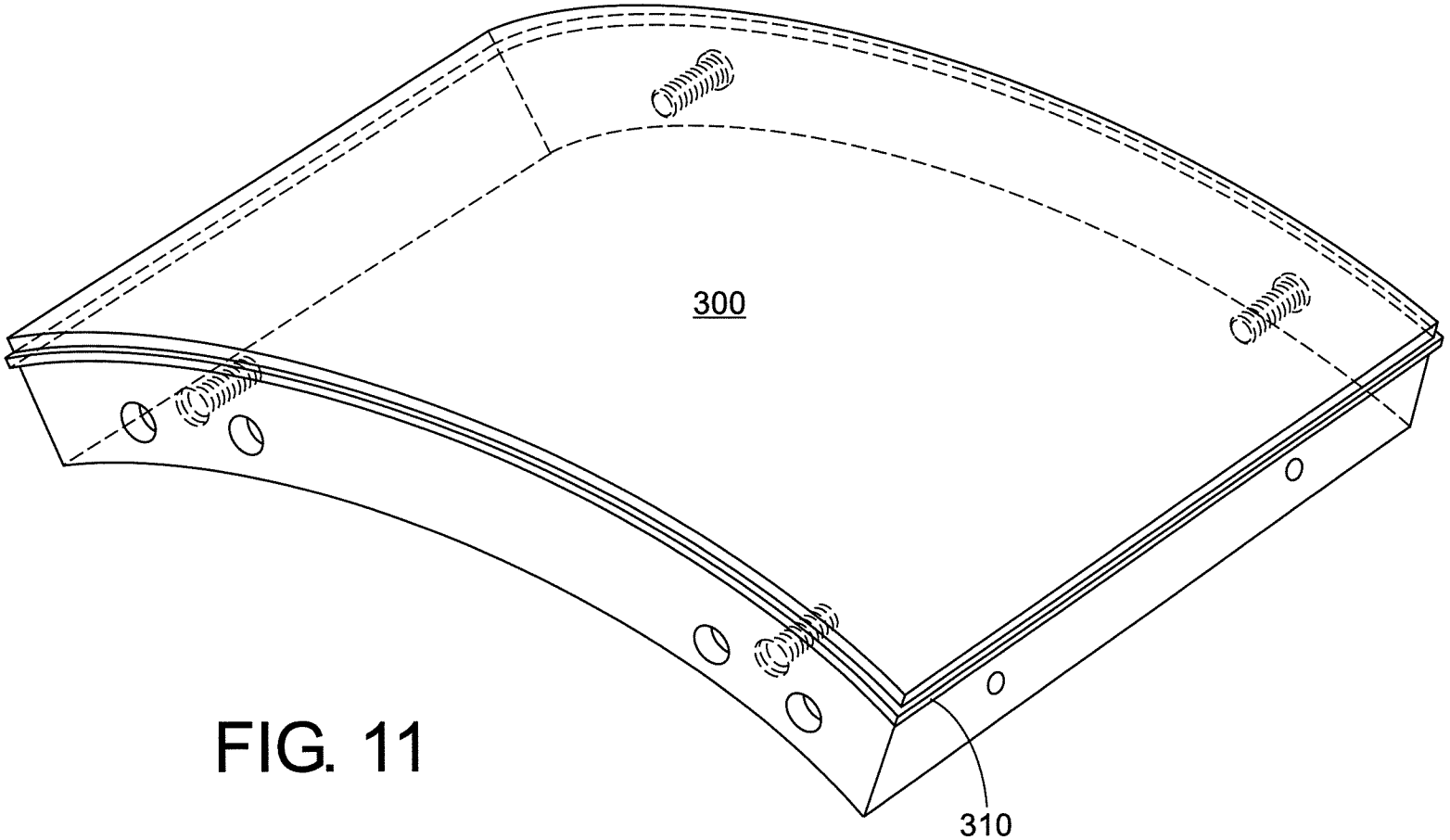
FIG. 11 is a perspective view of a tunnel segment to which a frame-like gasket with corner joints according to the present disclosure has been mounted.
Figure 12:
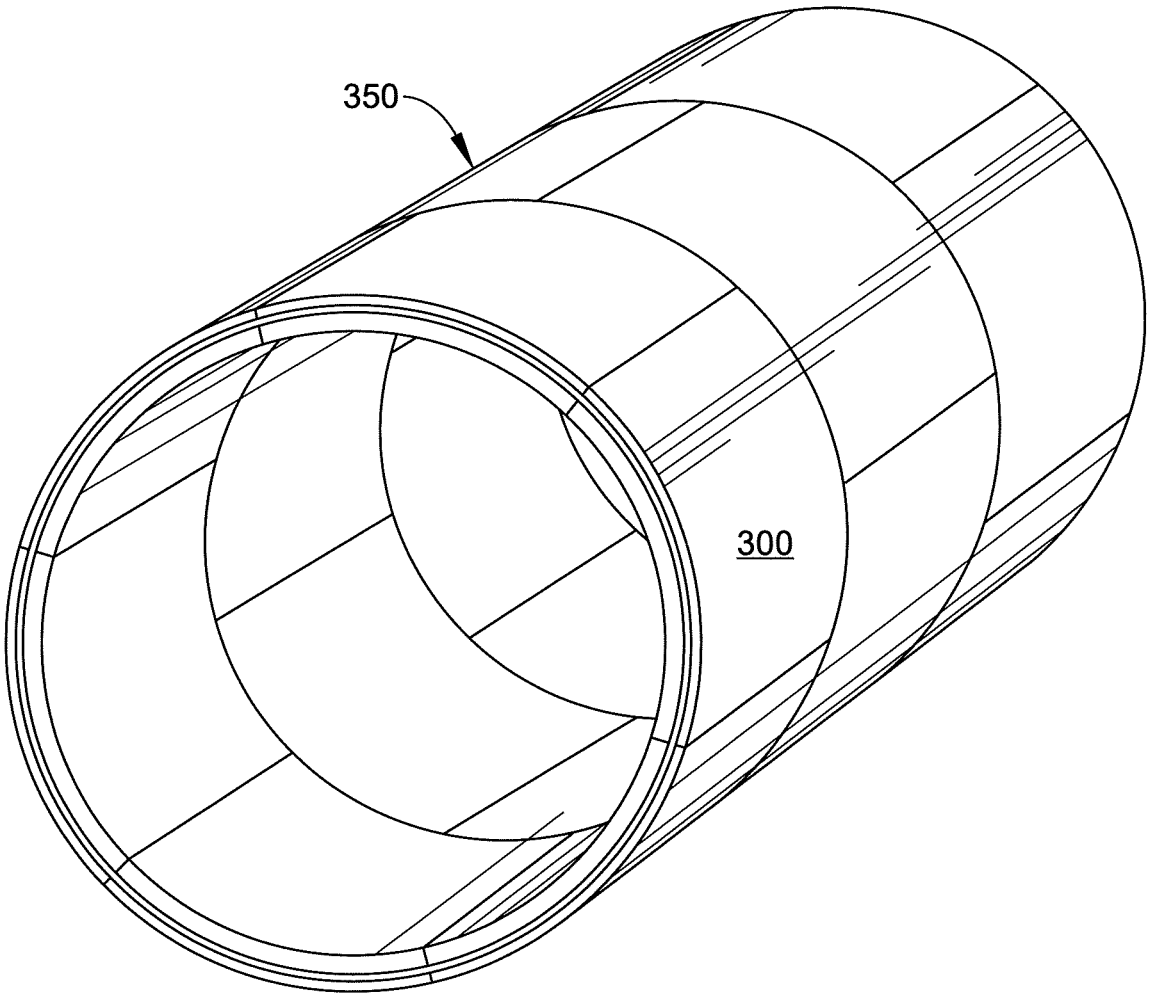
FIG. 12 is a perspective view of a portion of a concrete tunnel in which the tunnel segment of FIG. 11 is employed.

FIG. 11 illustrates a frame-like gasket construction according to the design illustrated in FIGS. 9 and 10 as mounted to a concrete tunnel segment 300. More particularly, the gasket construction, which includes four sides and four corners, sits in a groove 310 defined in the tunnel segment. With reference now to FIG. 12, the tunnel segment 300 can be employed as one of many segments in a generally circular tunnel construction 350.

Disclosed has been a tunnel segment gasket which includes first and second anchor members that protrude from opposed side edges at the base of the gasket. The anchor members are configured to attach the gasket to a concrete tunnel segment during the casting of the pre-cast concrete tunnel segment. As the tunnel segment is being cast from concrete, the gasket forms a groove in the concrete. It also forms side channels communicating with the groove, the side channels being defined by the anchor members of the gasket. Should a defect be found in the gasket which has been cast-in-place in the concrete tunnel segment or like concrete member, such a defective gasket can be removed from the groove relatively easily, and possibly in an intact manner. A replacement gasket can then be snapped into the groove in place of the original gasket. The replacement gasket will have corresponding anchor members which will extend into the side channels defined in the groove of the associated concrete member.

Also disclosed has been a corner joint or construction to provide a relatively soft radiused or rounded corner for a pair of adjacent gasket segments which may be linear in nature and angled in relation to each other. As concrete constructions such as tunnel segments are generally rectangular, trapezoidal or parallelogram-shaped in form, the soft radiused or rounded corner design allows for a frame-like gasket assembly or construction to be defined. In the case of damage to the gasket construction, the gasket construction can be removed and replaced with a replacement gasket construction in a generally simple manner, even in the field. In other words, the concrete member need not be taken back to the factory where the gasket construction that was cast-in-place with the concrete member would need to be removed and a replacement gasket installed, with the concrete segment then subsequently being sent back to the field. The damaged and replacement gasket constructions can have the same durometers for the elastomeric material of the sides and corner joints.

Such removal of damaged gasket constructions or gasket frames and their replacement with an undamaged gasket construction or gasket frame can, in the embodiments disclosed herein, take place in the field thereby saving both time and money during the installation process of a concrete structure. In fact, the damaged gasket construction or frame can be removed by stretching the gasket construction so that it can be pulled out of the tunnel segment groove in a generally intact manner. Also, unlike the prior art anchored gaskets which need to be cut out of a tunnel segment such that the anchoring legs remain in the concrete of the tunnel segment, the entire damaged gasket construction according to the instant disclosure can be removed. Moreover, the use of adhesives is not generally necessary for the installation of the replacement gasket construction or gasket frame. Rather, the inherent resiliency of the gasket construction or gasket frame allows a replacement gasket construction or gasket frame to be installed by stretching the replacement gasket construction, positioning it adjacent the tunnel segment and allowing it to be simply inserted into place in the groove of the tunnel segment.

The present disclosure has been described with reference to several embodiments. Obviously, modifications and alterations will occur to others upon a reading and understanding of the preceding detailed description. It is intended that the present disclosure be construed as including all such modifications and alterations insofar as they come within the scope of the appended claims or the equivalents thereof.

The invention claimed is:

1. A selectively detachable gasket construction for concrete structures, the gasket construction comprising:
- a first gasket portion extending in a first direction;
- a second gasket portion extending in a second direction that is angled away from the first direction;
- a first corner joint connecting the first and second gasket portions;
- wherein the first and second gasket portions each comprise an elastomeric material having a first durometer on the Shore A hardness scale;
- wherein the first corner joint comprises an elastomeric material having a second and lesser durometer on the Shore A hardness scale, such that the first corner joint is softer than either the first or second gasket portions;
- at least one bore extending longitudinally in each of the first gasket portion and the second gasket portion; and
- wherein the elastomeric material of the first corner joint extends into the at least one bore of the first and second gasket portions by 0.8 inches (2 cm).

2. The gasket construction of claim 1 wherein an inner face of the corner joint is rounded or radiused.

3. The gasket construction of claim 2 wherein a radius of the inner face of the corner joint is between 0.250 and 0.375 inches (0.635 and 0.753 cm).

4. The gasket construction of claim 1 wherein a plurality of spaced bores extend longitudinally in each of the first and second gasket portions.

5. The gasket construction of claim 1 further comprising third and fourth gasket portions and second, third and fourth joints so that the gasket construction defines a rectangular shape.

6. The gasket construction of claim 1 wherein the gasket body comprises ethylene propylene diene monomer (EPDM), Neoprene or a similar rubber material.

7. The gasket construction of claim 1 wherein the corner joint comprises ethylene propylene diene monomer (EPDM), Neoprene or a similar rubber material.

8. The gasket construction of claim 1 wherein the first and second gasket portions each extend along a respective axis and wherein the respective axes are oriented at an angle of between 80° to 100° in relation to each other.

9. The gasket construction of claim 1 wherein the first and second durometers are different from each other by at least 5 on the Shore A hardness scale.

10. A selectively detachable gasket construction for concrete structures, the gasket construction comprising:
- a first gasket portion extending in a first direction;
- a second gasket portion extending in a second direction that is angled away from the first direction;
- wherein the first and second gasket portions comprise a first elastomeric material and each gasket portion includes at least one bore which extends longitudinally in the respective gasket portion;
- a first corner joint connecting the first and second gasket portions;

wherein the first corner joint comprises a second elastomeric material, the second elastomeric material being of a lesser durometer on the Shore A hardness scale than the first elastomeric material; and wherein the second elastomeric material extends into the at least one bore of each of the first and second gasket portions.

11. The gasket construction of claim 10 wherein the second elastomeric material extends into the at least one bore of each of the first and second gasket portions by a distance which does not exceed 0.813 inches (20.65 mm).

12. The gasket construction of claim 10 wherein the first corner joint has a thickness between 0.250 and 0.813 inches (6.35 and 20.65 mm).

13. The gasket construction of claim 10 wherein an inner face of the first corner joint is rounded or radiused.

14. The gasket construction of claim 13 wherein a radius of the inner face of the first corner joint is between 0.250 and 0.375 inches (0.635 and 0.753 cm).

15. The gasket construction of claim 10 wherein a plurality of spaced bores extend longitudinally in each of the first and second gasket portions.

16. The gasket construction of claim 10 wherein the durometers of the first and second elastomeric materials differ from each other by at least 5 on the Shore A hardness scale.

17. A selectively detachable gasket construction for concrete structures, the gasket construction comprising:

a first gasket portion extending in a first direction;

a second gasket portion extending in a second direction that is angled away from the first direction;

wherein the first and second gasket portions comprise a first elastomeric material and each gasket portion includes at least one bore which extends longitudinally in the respective gasket portion;

a first corner joint connecting the first and second gasket portions;

wherein the first corner joint comprises a second elastomeric material, the second elastomeric material being of a lesser durometer on the Shore A hardness scale than the first elastomeric material; and wherein an inner face of the first corner joint is rounded or radiused in order to reduce point forces acting on an adjacent corner of an associated concrete structure to which the gasket construction is mounted wherein a radius of the inner face of the corner joint is between 0.250 and 0.375 inches (0.635 and 0.753 cm).

18. The gasket construction of claim 17 wherein the second elastomeric material extends into the at least one bore of each of the first and second gasket portions by a distance which does not exceed 0.813 inches (20.65 mm).

19. The gasket construction of claim 17 wherein the first corner joint has a thickness between 0.250 and 0.813 inches (6.35 and 20.65 mm).

* * * * *